United States Patent [19]

Otrhalek et al.

[11] 4,124,414

[45] Nov. 7, 1978

[54] POST PHOSPHATING INHIBITING RINSE

[75] Inventors: Joseph V. Otrhalek, Dearborn; Raymond M. Ajluni, West Bloomfield Township, Oakland County; Gilbert S. Gomes, Southgate, all of Mich.

[73] Assignee: BASF Wyandotte Corporation, Wyandotte, Mich.

[21] Appl. No.: 800,558

[22] Filed: May 25, 1977

[51] Int. Cl.[2] ..... C23F 7/10

[52] U.S. Cl. ..... 148/6.15 R; 148/6.15 Z

[58] Field of Search ..... 148/6.15 R, 6.15 Z; 252/389 R, 396, 87, 79.1, 142

[56] References Cited

U.S. PATENT DOCUMENTS

| | | | |
|---|---|---|---|
| 2,250,508 | 7/1941 | Thompson | 148/6.2 |
| 3,079,288 | 2/1963 | Schneider | 148/6.2 X |
| 3,110,684 | 11/1963 | Miller | 252/181 X |
| 3,507,795 | 4/1970 | Gardner | 252/87 |

*Primary Examiner*—Ralph S. Kendall

*Attorney, Agent, or Firm*—Robert J. Henry; Bernhard R. Swick; Robert E. Dunn

[57] ABSTRACT

Phosphated ferrous metal surfaces are treated with a rinse containing citric acid and sodium nitrite to enhance corrosion protection. This rinse has the advantages of providing an effluent which is not objectionable from an environmental viewpoint and does not stain the treated surfaces.

4 Claims, No Drawings

POST PHOSPHATING INHIBITING RINSE

BACKGROUND OF THE INVENTION

1. Field of the Invention

The present invention relates to ferrous metal surface corrosion inhibition, and particularly to a novel rinse step following a conventional phosphating treatment.

2. Description of the Prior Art

In metal finishing treatments for iron and steel, a chemical conversion coating is commonly deposited. Such coatings are of the iron phosphate of zinc phosphate type.

The coatings are applied to improve adhesion of paint and to enhance the overall corrosion resistance. The non-painted coatings do not offer much protection from corrosion. In order to compensate for this deficiency, the coatings are rinsed after the phosphating stage in what is referred to as an inhibiting seal or rinse.

The inhibiting rinse most commonly employed in the art is composed of chromic acid and water or chromic acid, phosphoric acid and water. The latter is commonly referred to as the modified chromic acid rinse.

These substances work extremely well and are commonplace in the metal finishing industry. However, they are not without certain disadvantages. First, the chromic acid by nature of its color has a tendency to stain and "bleed" through light-colored paints. Frequently, it is necessary to utilize a subsequent water rinse or reduce the amount of inhibiting chromic acid based seal in order to eliminate the problem. Secondly, it is of interest for environmental reasons to reduce or eliminate materials which are toxic in nature.

Thus the toxic nature of chromium rinses requires either the use of expensive disposal systems for removal of toxic chromium radicals, or the use of an alternative rinse system which has a simpler disposal problem. Accordingly, considerable effort has been expended to develop a satisfactory inhibiting seal or rinse which provides an effluent easily brought within standards of the EPA.

U.S. Pat. No. 3,966,502 utilizes a zirconium rinse, and the patentee suggests that the zirconium run-off can easily be recovered. Various other patentees have suggested other alternative rinses, all of which have advantages and disadvantages. Obviously, the most desirable rinse would be sufficiently compatible with the environment that no effluent treatment would be needed. The present invention provides such a rinse.

SUMMARY OF THE INVENTION

It has now been found that nitrite ions may be used in combination with citrate ions in an aqueous solution to achieve corrosion inhibition. This rinse solution thus avoids the adverse effects associated with using chromium based compounds.

Thus the invention provides an inhibiting rinse for sealing phosphated ferrous metal surfaces, comprising a solution consisting essentially of from about 0.04 to 0.22 weight percent of a water-soluble metal nitrite, from about 0.005 to 0.05 weight percent of a water-soluble citrate, and the remainder substantially all water.

In addition, the invention provides an improved process for treating ferrous metal articles, in which a novel rinse step is included, and which is defined as follows:

In a method of phosphating a ferrous metal surface, wherein the surface is treated to provide a coating of the iron phosphate or zinc phosphate type;

a separate and subsequent rinse step which comprises rinsing the phosphated metal surface with an aqueous solution containing from about 0.40 to 2.2 grams per liter of nitrite ions and about 0.05 to about 0.50 grams per liter of citrate ions.

For a more comprehensive discussion of the present invention, reference is made to the following detailed description and examples.

DESCRIPTION OF THE PREFERRED EMBODIMENT

In accordance with the invention, a chrome-free final rinse is provided in a process for treating surfaces of ferrous metal. The term "ferrous metal", as used herein, is meant to include iron, wrought iron, and iron-carbon alloys, such as any of the various steels.

According to the present process, ferrous metal surfaces are rendered corrosion resistant by a first step in which the surface is phosphated to provide a conversion coating, followed by a rinse step in which the conversion coating is sealed to enhance its corrosion-resistant properties.

The conversion coating will have been applied using commonly employed processes and techniques known to the art. Particularly, the conversion coatings employed prior to the process of the present invention are those referred to as phosphate coatings. By phosphate coatings, we mean the crystalline zinc phosphate coatings produced from aqueous baths containing primary zinc phosphate with phosphoric acid, and the iron phosphate coatings produced from aqueous baths containing alkali metal or ammonium acid phosphates. The iron phosphate coatings can be employed over iron, steel, or alloys thereof, and the zinc phosphate coatings can be applied on iron, steel, zinc, aluminum, or alloys thereof. Examples of commonly practiced zinc phosphate and iron phosphate coating processes and compositions can be found in U.S. Pat. Nos. 3,333,988; 3,297,494; 3,425,876; 3,520,737; 3,101,286; 2,987,428 and 3,129,123.

The coating process will ordinarily include a prior cleaning step, intervening rinsing steps, an activating step, and the conversion coating application.

The cleaning step, which forms no part of the present invention, is necessary to insure complete physical contact of the subsequently applied coating solution with the metal surface and to remove any grease and soil films that are on the metal surface. This cleaning and degreasing process, usually effected by spraying, can be accomplished with known alkaline cleaning agents. After the surface has been effectively cleaned, it will require at least one water rinse to completely remove the cleaner from the metal surface. The water rinse can be followed by an activating treatment before the conversion coating is deposited on the metal surface.

In the coating operation, the workpiece is brought into contact with the aqueous coating solution under suitable conditions of temperature, pH and contact time. Contact is effected by either spraying, immersion techniques, roller coating, or brushing to produce the desired surface conversion coating. Subsequent to the formation of said conversion coating, the process step of the present invention is utilized.

The present invention can be effected with or without an intervening water rinse between the prior conversion coating application and the aftertreatment prescribed herein. As intervening rinse is employed when it is desired to remove any adhering ingredients on the surface carried over from the coating bath, which may cause subsequent corrosion or paint blistering should they remain thereon.

The second step of the process generally comprises applying onto the phosphated surface, a rinse solution containing small amounts of both nitrite ions and citrate ions. In general, the nitrite ions will be provided in the form of a soluble salt such as sodium nitrite or potassium nitrite. Alternatively, nitrous acid could be used but the salts are easier to handle. In addition, cations that would adversely affect the phosphate coating must be avoided, and cations which provide a pollution effluent should be avoided. Similarly, any soluble source for the citrate ion may be used, so long as undesirable cations are avoided. Citric acid is preferred, because of its availability and ease in handling. In addition, the use of citric acid plus alkali nitrite usually provides the desired pH.

It is an essential aspect of this invention, that both "nitrite" and "citrate" must be used. Experimental evidence has shown that either one alone does not achieve the desired result, whereas the use of both together considerably enhances the corrosion resistance of the treated surface. In other words, there is a definite synergistic result achieved by the combination.

The minimum amount of nitrite ion that should be used is about 0.40 grams per liter or, say, about 0.6 grams per liter of sodium nitrite, and the minimum amount of citrate is about 0.05 grams per liter or about 0.05 grams per liter of citric acid. The maximum amount of these components varies somewhat with the ratio of the two, but it has been found to be about 2.2 grams per liter of nitrite ion or, say about 3.3 grams per liter of sodium nitrite, and amounts of citrate or citric acid to be about 0.5 grams per liter. Best results are obtained when about 1.6 grams per liter of sodium nitrite or equivalent is used with about 0.2 grams per liter of citric acid.

It is important that the pH of the solution be in the range of about 4 to 5. However, the temperature of the rinse is not critical. Preferably, however, a warm-to-hot rinse is used to facilitate drying of the rinsed articles. The rinse solution is applied to the treated surface by any conventional method such as spraying or immersing at atmospheric pressure for a time sufficient to seal the phosphated surface. In general, contact of the order of 30 seconds is sufficient and contacts of more than 1 minute do not enhance the sealing effect any further.

For a more complete understanding of the present invention, reference is made to the following examples which are not to be construed as limitative of the invention. In the examples all parts are by weight, absent indications to the contrary.

EXAMPLE 1

This example illustrates the preparation of corrosion-resistant ferrous surfaces in accordance with the present invention.

Low carbon steel panels were cleaned by immersion for about 5 minutes in a caustic solution maintained at about 170° to 180° F. The caustic bath consists of, by weight, 2% caustic soda; 2% soda ash; 0.9% sodium metasilicate; 0.8% sodium tripolyphosphate; 0.3% sodium lignin sulfonate; 0.1% sodium gluconate; 0.6% sodium linear alkylate sulfonate and 93.3% water.

After cleaning, the panels were then rinsed with water to remove any residuals of the caustic solution.

The panels were then zinc phosphated by immersing them in a zinc phosphating solution maintained at about 150° to 165° F. for about 10 minutes. The zinc phosphating solution used herein consists essentially of, by weight, 0.8% zinc ions, 2.4% phosphate ions, 0.07% nickel ions, 0.6% nitrate ions and 0.3% ferrous ions. The panels were then removed from the solution, rinsed with water at a temperature of about 130° F. to promote dry off, and dried with a forced air drier at 300° F.

The panels were then immersed for 30 seconds at about 60° C. in an aqueous solution containing 1.6 grams per liter of sodium nitrite and 0.1 grams per liter of citric acid. The panels were then removed from the rinse solution and dried.

EXAMPLE 2

The procedure of Example 1 was repeated, except that the citric acid was omitted from the rinse solution to provide a comparison result.

EXAMPLE 3

The procedure of Example 1 was repeated, except that the sodium nitrite was omitted from the rinse solution to provide another comparison result.

EXAMPLE 4

The procedure of Example 1 was repeated, except that the rinse was pure water in order to provide a control example.

The panels prepared according to Examples 1 through 4 were then exposed for 2 hours in a 5% salt fog according to ASTM-B117. The amount of rust forming is shown in Table I below in which an average result for 3 panels is given for each example.

Table I

| Inhibiting Rinse | % Rust after 2 Hours in Salt Spray |
|---|---|
| Example 1 | <10% |
| Example 2 | 40% |
| Example 3 | 40% |
| Example 4 | 100% |

From Table I above, it is seen that the use of either citric acid or sodium nitrite in the rinse water improves the resistance to corrosion. However, it is also seen that the combination of citric acid and sodium nitrite is considerably better than the use of either ingredient alone.

EXAMPLE 5

A group of low carbon steel panels were cleaned and zinc phosphated in accordance with the procedure of Example 1.

The phosphated panels were then immersed for 30 seconds at about 60° C. in an aqueous solution containing 1.6 grams per liter of sodium nitrite and 0.19 grams per liter of citric acid. The panels were then removed from the rinse solution and dried.

EXAMPLE 6

A group of low carbon steel panels were cleaned and zinc phosphated in accordance with the procedure of Example 1.

The phosphated panels were then immersed for 30 seconds at about 60° C. in an aqueous solution containing 0.8 grams per liter of sodium nitrite and 0.48 grams per liter of citric acid. The panels were then removed from the rinse solution and dried.

EXAMPLE 7

The procedure of Example 1 was repeated except that the rinse solution contained 2.0 grams per liter of sodium nitrite and no citrate ion.

EXAMPLE 8

The procedure of Example 1 was repeated except that the rinse solution contained 0.48 grams per liter of citric acid and no nitrite ion.

Groups of 3 panels of certain of the above examples were exposed for 2 hours in a 5% salt fog according to ASTM-B117. The samples were then rated on a scale of 1 to 7, with a rating of 1 indicating very little corrosion and a rating of 7 indicating very heavy corrosion. These test results are given in Table II below.

Table II

| Sample | Rating |
|---|---|
| 1 | 5 |
| 2 | 6 |
| 4 | 7 |
| 5 | 3 |
| 6 | 4 |
| 7 | 6 |
| 8 | 6 |

From Table II it is seen that uses of different amounts of citric acid alone or sodium nitrite alone in the rinse caused only a small improvement in the corrosion resistance. On the other hand, various combinations of citric acid and sodium nitrite provided considerable improvement in corrosion resistance.

The embodiments of the invention in which an exclusive property or privilege is claimed are defined as follows:

1. In a method of phosphating a ferrous metal surface, wherein the surface is treated to provide a coating of the iron phosphate or zinc phosphate type;

a separate and subsequent rinse step which comprises rinsing the phosphated metal surface with an aqueous solution consisting essentially of from about 0.40 to about 2.2 grams per liter of nitrite ions and about 0.05 to about 0.5 grams per liter of citrate ions.

2. A method of phosphating a ferrous metal surface, as defined in claim 1, in which the pH of the rinse solution is from about 4 to about 5.

3. A method of phosphating a ferrous metal surface, as defined in claim 1, in which the rinse solution contains from about 0.8 to 2.0 grams per liter of sodium nitrite, and from about 0.1 to 0.5 grams per liter of citric acid.

4. A method of phosphating a ferrous metal surface, as defined in claim 3, in which the sodium nitrite is present in a concentration of about 1.6 grams per liter, and the citric acid is present in a concentration of about 0.2 grams per liter.

* * * * *